US011512395B2

(12) United States Patent
Hirano

(10) Patent No.: US 11,512,395 B2
(45) Date of Patent: Nov. 29, 2022

(54) METHOD OF MANUFACTURING LAMINATE

(71) Applicant: NHK Spring Co., Ltd., Yokohama (JP)

(72) Inventor: Satoshi Hirano, Kanagawa (JP)

(73) Assignee: NHK Spring Co., Ltd., Yokohama (JP)

( * ) Notice: Subject to any disclaimer, the term of this patent is extended or adjusted under 35 U.S.C. 154(b) by 0 days.

(21) Appl. No.: 17/263,573

(22) PCT Filed: Aug. 6, 2019

(86) PCT No.: PCT/JP2019/031006

§ 371 (c)(1),
(2) Date: Jan. 27, 2021

(87) PCT Pub. No.: WO2020/032074

PCT Pub. Date: Feb. 13, 2020

(65) Prior Publication Data

US 2021/0301404 A1 Sep. 30, 2021

(30) Foreign Application Priority Data

Aug. 10, 2018 (JP) ..... JP2018-151941

(51) Int. Cl.
*C23C 24/04* (2006.01)
*F28F 13/18* (2006.01)

(52) U.S. Cl.
CPC ..... *C23C 24/04* (2013.01); *F28F 13/185* (2013.01)

(58) Field of Classification Search
None
See application file for complete search history.

(56) References Cited

U.S. PATENT DOCUMENTS 6,468,669 B1 * 10/2002 Hasz ..... F28F 13/185 428/553
2009/0120539 A1 5/2009 Ko et al.
2014/0134448 A1 * 5/2014 Yamauchi ..... B05D 1/12 427/314

(Continued)

FOREIGN PATENT DOCUMENTS

CN 104704144 A 6/2015
CN 108291310 A 7/2018

(Continued)

OTHER PUBLICATIONS

Office Action dated Mar. 3, 2020, issued for TW Patent Application No. 108128444 and English translation thereof.

(Continued)

*Primary Examiner* — Alexander M Weddle
(74) *Attorney, Agent, or Firm* — Locke Lord LLP; James E. Armstrong, IV; Nicholas J. DiCeglie, Jr.

(57) ABSTRACT

A method of manufacturing a laminate includes: forming a preprocessing coating on a surface of a substrate having insulating properties by accelerating the powdered material together with gas and spraying the powdered material in a solid phase onto the surface of the substrate, the powdered material including aluminum or an aluminum alloy as a main component; and forming a heat-treated coating having a surface with irregular asperities by heating a preprocessing laminate including the substrate and the preprocessing coating formed on the surface of the substrate.

2 Claims, 4 Drawing Sheets

(56) References Cited

U.S. PATENT DOCUMENTS

| | | | | |
|---|---|---|---|---|
| 2015/0251196 | A1 | 9/2015 | Hirano | |
| 2018/0298498 | A1 | 10/2018 | Araki et al. | |
| 2019/0364667 | A1* | 11/2019 | Sakaki | H05K 3/381 |
| 2020/0128677 | A1 | 4/2020 | Sakai et al. | |

FOREIGN PATENT DOCUMENTS

| | | | | |
|---|---|---|---|---|
| JP | 2008-538385 | A | 10/2008 | |
| JP | 2011-208166 | A | 10/2011 | |
| JP | 5548167 | B2 | 7/2014 | |
| JP | 2016-183390 | A | 10/2016 | |
| WO | 2018/135490 | A1 | 7/2018 | |
| WO | 2018-135499 | A1 | 7/2018 | |
| WO | WO-2018135490 | A1 * | 7/2018 | B32B 37/02 |
| WO | WO-2018135499 | A1 * | 7/2018 | C23C 24/04 |

OTHER PUBLICATIONS

International Search Report dated Nov. 5, 2019, issued for PCT/JP2019/031006.

Extended European Search Report issued in EP 19848727.4, dated Mar. 25, 2022.

Office Action issued in Chinese Patent Application No. CN 201980051612.4, dated Aug. 29, 2022.

* cited by examiner

METHOD OF MANUFACTURING LAMINATE

FIELD

The present invention relates to a method of manufacturing a laminate formed by overlaying a metallic coating on a substrate.

BACKGROUND

Conventionally, methods for preparing a laminate in which a metallic coating is formed on a substrate include, for example, the thermal spray method and the cold spray method. The thermal spray method is a method of forming a coating by spraying, onto a substrate, a material (thermal spray material) that is melted or heated so as to be in an almost melted state. The cold spray method is a method of forming a coating on a surface of a substrate by emitting a powdered material together with inert gas in a state of being equal to or below the melting point or the softening point from a divergent (de Laval) nozzle and allowing the material in a solid phase to impact the substrate (for example, see Patent Literature 1). In the cold spray method, processing is executed at a low temperature in comparison with the thermal spray method, and thus effect of thermal stress is reduced. Therefore, a metallic coating with no phase transformation and with controlled oxidation can be obtained. In particular, when a substrate and a coating are both made from metal, impact of a powdered metal material on the substrate (or a preliminarily formed coating) generates plastic deformation between the powder and the substrate, yielding anchor effect, and destroys oxide coatings of the powder and the substrate, generating metallic bond between newly formed surfaces, which can provide a laminate having high adhesive strength.

Now, a metallic coating may have a function of dissipating heat of a substrate to the outside in some cases. It is generally known that a surface where heat dissipation is performed is made rough to enable efficient heat dissipation (for example, see Patent Literature 2).

CITATION LIST

Patent Literature

Patent Literature 1: Japanese Patent No. 5548167

Patent Literature 2: Japanese Patent Application Laid-open No. 2016-183390

SUMMARY

Technical Problem

In view of the aforementioned, a technique of preparing, by the cold spray method, a metallic coating that has high strength in adhesion to a substrate and can efficiently dissipate heat is desired.

In light of the foregoing, an object of the present invention is to provide a method of manufacturing a laminate that has high adhesive strength and can efficiently dissipate heat.

Solution to Problem

In order to solve the above-described problem and achieve the object, a method of manufacturing a laminate according to the present invention including a coating formed by using a powdered material laminated on a surface of a substrate having insulating properties, the method including: a preprocessing step of forming a preprocessing coating on the surface of the substrate by accelerating the powdered material together with gas and spraying the powdered material in a solid phase onto the surface of the substrate, the powdered material including aluminum or an aluminum alloy as a main component; and a coating forming step of forming a heat-treated coating having a surface with irregular asperities by heating a preprocessing laminate in which the preprocessing coating is formed on the surface of the substrate.

Moreover, in the above-described method of manufacturing a laminate according to the present invention, the powdered material further includes an additive enabling bonding of the powdered material, and the additive is a brazing filler metal or magnesium.

Moreover, in the above-described method of manufacturing a laminate according to the present invention, the coating forming step includes heating the preprocessing coating at a temperature of 300° C. or higher and 650° C. or lower.

Advantageous Effects of Invention

The present invention achieves effect of high adhesive strength and efficient heat dissipation.

DESCRIPTION OF EMBODIMENTS

Embodiments of the present invention will now be described in detail with reference to the drawings. Note that the following embodiments should not be construed to limit the present invention. Furthermore, each of the drawings referred to in the following description is simply for schematic illustration of shapes, sizes, and positional relations to the extent that the contents of the present invention are understandable. In other words, the present invention is not limited only to the shapes, sizes, and positional relations exemplified in each drawing.

Figure 1:
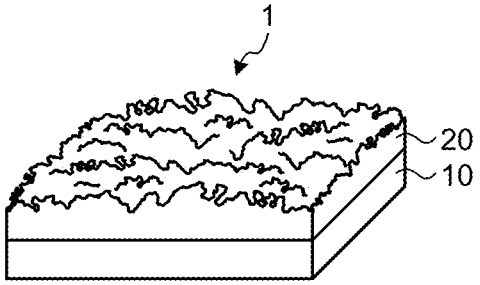
FIG. 1 is a sectional view illustrating a structure of a laminate according to an embodiment of the present invention.
Figure 2:
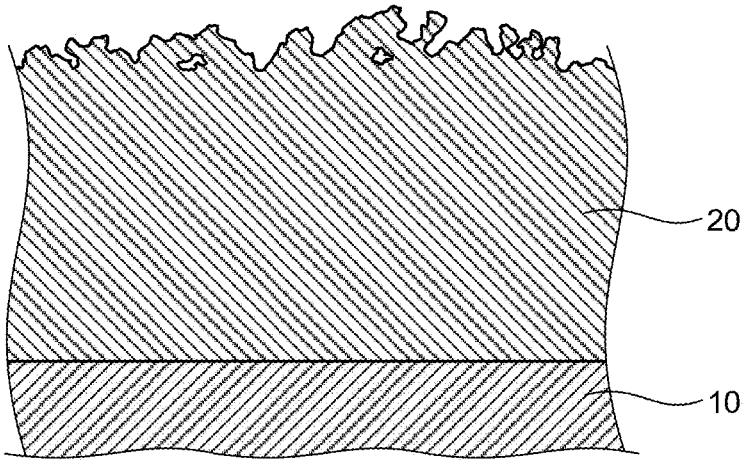
FIG. 2 is an enlarged sectional view of a portion of the laminate illustrated in FIG. 1.

FIG. 1 is a sectional view illustrating a structure of a laminate according to an embodiment of the present invention. FIG. 2 is an enlarged sectional view of a portion of the laminate illustrated in FIG. 1. The laminate 1 illustrated in FIG. 1 includes a substrate 10 and a metallic coating 20 formed on one surface of the substrate 10.

The substrate 10 is a substantially plate-shaped member. The substrate 10 is made of, for example, aluminum, nitride-based ceramics, such as aluminum nitride and silicon nitride, oxide-based ceramics, such as alumina, magnesia, zirconia, steatite, forsterite, mullite, titania, silica, and sialon, a resin layer having an inorganic filler as a component, and the like. The substrate 10 may be mounted with, for example, a chip constituted by a semiconductor device, such as a diode, a transistor, and an insulated gate bipolar transistor (IGBT).

The metallic coating 20 has, as the main component, a metal or an alloy having good thermal conductivity, such as aluminum and an aluminum alloy. The metallic coating 20 is formed by the cold spray method that will be described later. The metallic coating 20 discharges heat input into the substrate 10 or heat stored in the substrate 10 to the outside.

Furthermore, the metallic coating 20 is formed by the cold spray method at a low temperature, and thus effect of thermal stress is reduced. Therefore, a metallic coating with no phase transformation and with controlled oxidation can be obtained. In particular, impact of a powdered material on the substrate 10 generates plastic deformation between the powdered material and the material of the substrate 10, yielding anchor effect, and destroys oxide coatings of the powdered material and the material of the substrate 10, generating metallic bond between newly formed surfaces, which can provide a laminate having high adhesive strength.

As illustrated in FIG. 2, the metallic coating 20 has a rough surface on a side opposite to the side coming into contact with the substrate 10. This surface has irregular asperities repeatedly and has a larger surface area than a case of a flat surface. In specific, in the metallic coating 20, the surface is formed by irregularly overlaying particles (here, the material composing the metallic coating 20).

Figure 3:
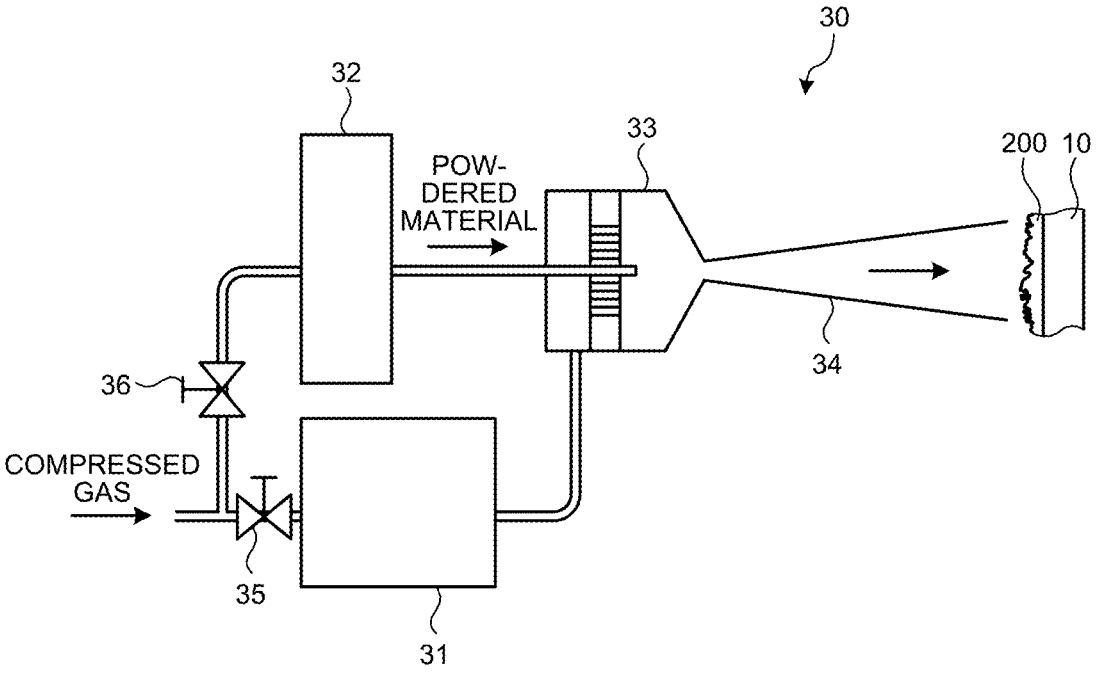
FIG. 3 is a schematic view briefly illustrating a cold spray device used for forming a metallic coating of the laminate according to the embodiment of the present invention.

Next, a method of forming the metallic coating 20 in preparation of the laminate 1 will be described. FIG. 3 is a schematic view briefly illustrating a cold spray device used for forming the metallic coating of the laminate according to the embodiment of the present invention.

First, the substrate 10 described above is prepared. This substrate 10 may be mounted with the aforementioned chip. If the chip is mounted on the substrate 10, the coating is formed on a surface on a side opposite to the side having the mounted surface.

A cold spray device 30 illustrated in FIG. 3 accelerates a powdered material for forming the metallic coating 20 together with gas and sprays and deposits the material in a solid phase onto the surface of the substrate 10 to form a preprocessing coating 200 on the substrate 10 (preprocessing step).

The cold spray device 30 includes a gas heater 31 heating compressed gas, a powder feeder 32 accommodating the powdered material for forming the metallic coating 20 and feeding the material to a spray gun 33, a gas nozzle 34 emitting, to the substrate, the heated compressed gas and the powdered material fed to the spray gun 33, a valve 35 regulating the amounts of the compressed gas to be fed to the gas heater 31, and a valve 36 regulating the amounts of the compressed gas to be fed to the powder feeder 32.

The material for forming the metallic coating 20 is a powdered material composed of aluminum or an aluminum alloy being the main component of the metallic coating 20 and an additive for enabling bonding of aluminum or of the aluminum alloy. The blend ratio of the main component to the additive (main component:additive) is 1 to 1 or greater and 1.5 or less. Note that the "main component of the metallic coating 20" mentioned herein indicates a component of which the content rate is highest among components composing the metallic coating 20 (elements or alloys remaining after forming the coating).

As the additive, a material having reduction action on an oxide coating of aluminum and a brazing filler metal are listed. As a material having good reduction action, magnesium and zinc are listed, and magnesium is preferable from the viewpoint of good reduction action on aluminum. As the brazing filler metal, an aluminum brazing filler metal having aluminum as the main component and containing magnesium, copper, and the like or a silver brazing filler metal having silver as the main component and containing at least one of copper and tin and titanium being an active metal can be used.

As the compressed gas, helium, nitrogen, air, or the like is used. The compressed gas fed to the gas heater 31 is, for example, at 50° C. or higher, and is heated to a temperature in a range lower than the melting point of the powdered material for forming the metallic coating 20 and then fed to the spray gun 33. The compressed gas is heated preferably to a temperature of 300° C. or higher and 650° C. or lower. On the other hand, the compressed gas fed to the powder feeder 32 is fed so that the powder in the powder feeder 32 is supplied to the spray gun 33 in a predetermined discharging rate.

The gas nozzle 34 having a divergent shape enables the heated compressed gas to have a hypersonic flow (approximately 340 m/s or higher). At this time, the compressed gas preferably has a gas pressure of approximately 1 to 5 MPa. This is because the pressure of the compressed gas controlled in this range can enhance strength in adhesive of the metallic coating 20 to the substrate 10. The processing is performed more preferably at a pressure of approximately 2 to 4 MPa, even more preferably approximately 1.5 to 2.5 MPa. The powdered material fed to the spray gun 33 is accelerated by being put into this hypersonic flow of the compressed gas, and impacts the substrate 10 at high speed and is deposited on the substrate 10 in a solid phase to form the preprocessing coating 200. Note that the device is not limited to the cold spray device 30 illustrated in FIG. 3 as long as the powdered material in a solid phase can impact the substrate 10 and form the coating with the device.

The preprocessing coating 200 formed with the aforementioned cold spray device 30 contains the main component (aluminum or an aluminum alloy) and the additive and is formed so as to have a gap and a minute space. This preprocessing coating 200 is subjected to heat treatment to enable bonding of the main component, of the additive, and of the main component and the additive to form the metallic coating 20 (coating forming step). This heat treatment is performed at a temperature of 300° C. or higher and 650° C. or lower, preferably 500° C. or higher and 600° C. or lower. In this way, bond strength of the metallic coating 20 can be enhanced. At this time, depending on properties of the additive and conditions of the heat treatment, an added substance in the metallic coating 20 may partially evaporate, melt, or remain in a state of the preprocessing coating 200. At this time, as the additive, magnesium is preferable in order to reduce an oxide film of aluminum powder and to promote bonding of the aluminum powder.

Figure 4:
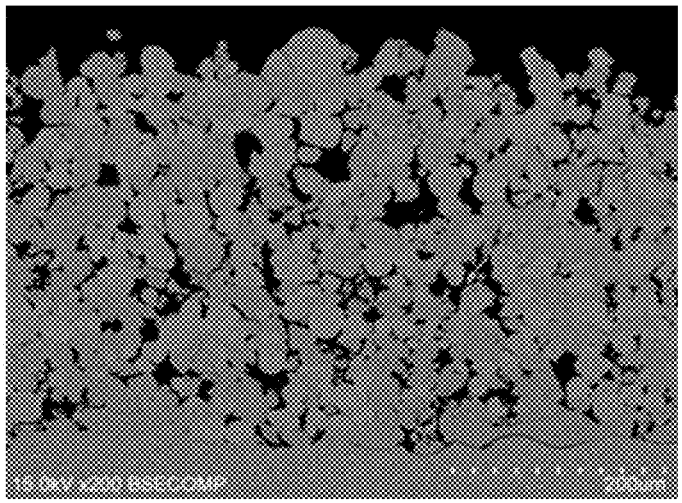
FIG. 4 is an SEM image of an example laminate according to the embodiment of the present invention, the SEM image illustrating a section of this laminate.
Figure 5:
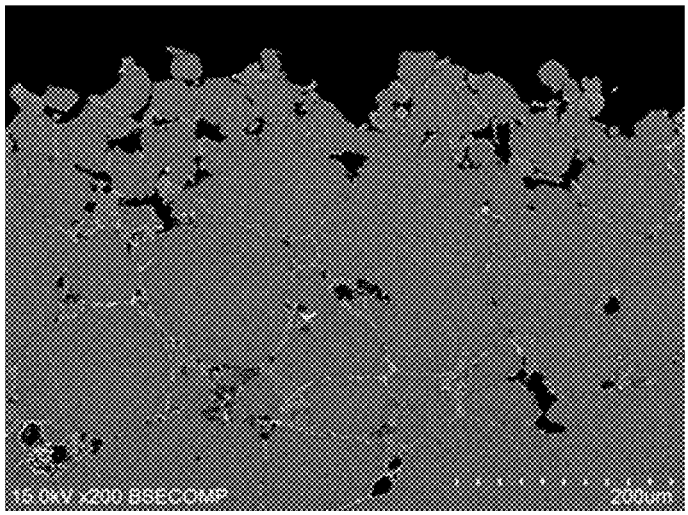
FIG. 5 is an SEM image of the example laminate according to the embodiment of the present invention, the SEM image illustrating a section of this laminate.

FIG. 4 and FIG. 5 are SEM images of an example laminate according to the embodiment of the present invention, the SEM images each illustrating a section of this laminate. FIG. 4 and FIG. 5 exemplify a case in which aluminum is the main component and a brazing filler metal is used as the additive. FIG. 4 illustrates a section after a coating (preprocessing coating 200) is formed with the cold spray device 30. FIG. 5 illustrates a section of a metallic coating (metallic coating 20) formed through the heat treatment after the coating forming. A large number of gaps and the like and a large number of portions with no bonding of powder are found in the state after the coating forming (see FIG. 4); however, after the heat treatment (see FIG. 5), a large number of the gaps are filled, and bond strength is enhanced in comparison with after the coating forming.

Figure 6:
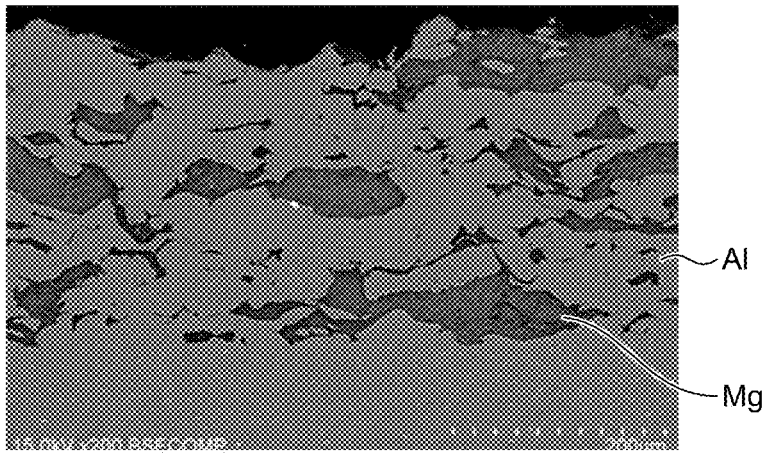
FIG. 6 is an SEM image of an example laminate according to the embodiment of the present invention, the SEM image illustrating a section of this laminate.
Figure 7:
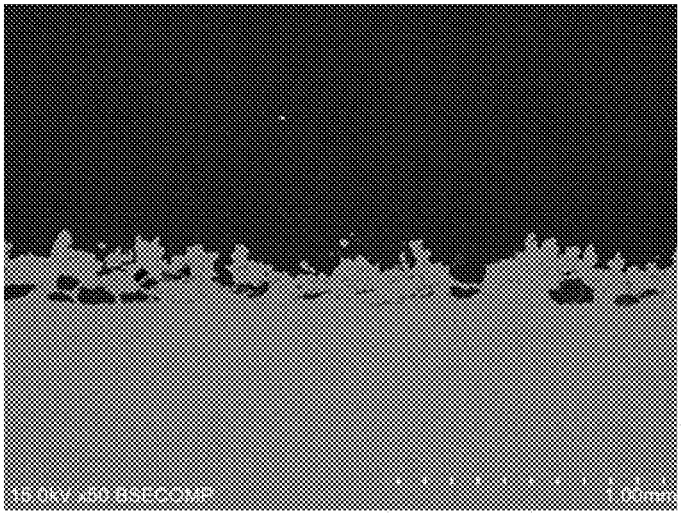
FIG. 7 is an SEM image of the example laminate according to the embodiment of the present invention, the SEM image illustrating a section of this laminate.
Figure 8:
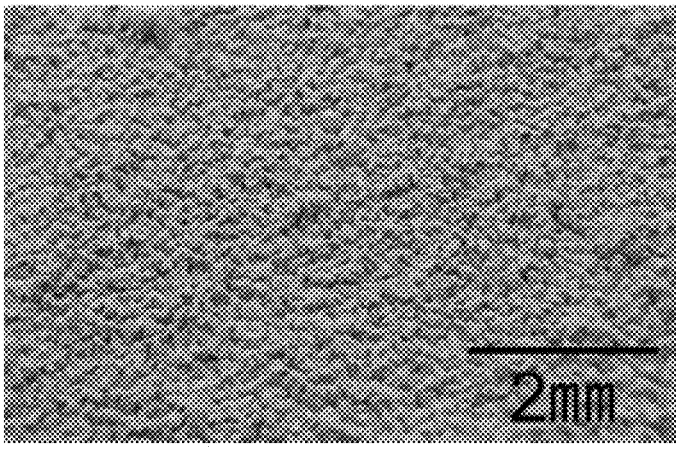
FIG. 8 is an SEM image of the example laminate according to the embodiment of the present invention, the SEM image illustrating a surface of this laminate.

Furthermore, an example using magnesium as the additive is described with reference to FIG. 6 to FIG. 8. FIG. 6 to FIG. 8 are SEM images of an example laminate according to the embodiment of the present invention, the SEM images each illustrating a section of this laminate. FIG. 6 to FIG. 8 exemplify a case in which aluminum is the main component and magnesium is used as the additive. FIG. 6 illustrates a section after a coating (preprocessing coating 200) is formed with the cold spray device 30. FIG. 7 illustrates a section of a metallic coating (metallic coating 20) formed through the heat treatment after the coating forming. FIG. 8 illustrates a surface of the metallic coating in a state after the coating forming and then the heat treatment. Similar to the case of the brazing filler metal, a large number of gaps and the like and a large number of portions with no bonding of powder are found in the state after the coating forming (see FIG. 6); however, after the heat treatment (see FIG. 7), a larger number of the gaps are filled, and bond strength is enhanced in comparison with after the coating forming. Moreover, as illustrated in FIG. 8, it is found that the surface after the heat treatment is shaped so as to have irregular asperities.

In the above-described embodiment, the powdered material that is for forming the metallic coating 20 and includes the main component being aluminum or an aluminum alloy and the additive enabling bonding of the powder is accelerated together with gas, and is sprayed and deposited onto the surface of the substrate 10 in a solid phase to form the preprocessing coating 200 having a rough surface, and this preprocessing coating 200 is subjected to heat treatment to enhance bond strength. According to the above-described embodiment, adhesive strength is high, and heat can be efficiently dissipated.

Note that the above-described embodiment has exemplified a case in which the metallic coating 20 is formed using the powdered material including the main component being aluminum or an aluminum alloy and the additive enabling bonding of the powder; however, the metallic coating 20 may be formed using a powdered material including only the main component.

In this way, the present invention may include various embodiments or the like that are not described herein, and various design modifications or the like can be made without departing from the technical concepts specified by the appended claims.

INDUSTRIAL APPLICABILITY

As described above, a method of manufacturing a laminate according to the present invention is suitable for providing high adhesive strength and efficient heat dissipation.

REFERENCE SIGNS LIST

1 LAMINATE
10 SUBSTRATE
20 METALLIC COATING
30 COLD SPRAY DEVICE
31 GAS HEATER
32 POWDER FEEDER
33 SPRAY GUN
34 GAS NOZZLE
35, 36 VALVE
200 PREPROCESSING COATING

The invention claimed is:

1. A method of manufacturing a laminate, the method comprising:

forming a coating on a surface of a substrate having insulating properties by accelerating the powdered material together with gas and spraying the powdered material in a solid phase onto the surface of the substrate, the powdered material including aluminum or an aluminum alloy as a main component; and forming a heat-treated coating having a surface with irregular asperities by heating a laminate including the substrate and the coating formed on the surface of the substrate, wherein the powdered material further includes an additive enabling bonding of the powdered material, the additive is a brazing filler metal or magnesium, and a blend ratio of the main component to the additive is 1 to 1 or greater and 1.5 or less.

2. The method according to claim 1, wherein the laminate is heated at a temperature of 300° C. or higher and 650° C. or lower.

* * * * *